US010125759B2

(12) United States Patent
Pyron et al.

(10) Patent No.: US 10,125,759 B2
(45) Date of Patent: Nov. 13, 2018

(54) FLEXIBLE HOSE FOR BELLOWS PRESSURE EQUALIZER OF ELECTRICAL SUBMERSIBLE WELL PUMP

(71) Applicant: Baker Hughes Incorporated, Houston, TX (US)

(72) Inventors: Steven W. Pyron, Tulsa, OK (US); Kelsey A. McKinney, Claremore, OK (US); Robert Clay Patterson, Stillwell, OK (US); Kevin R. Bierig, Tulsa, OK (US)

(73) Assignee: BAKER HIGHES, A GE COMPANY, LLC, Houston, TX (US)

( * ) Notice: Subject to any disclaimer, the term of this patent is extended or adjusted under 35 U.S.C. 154(b) by 297 days.

(21) Appl. No.: 15/095,627

(22) Filed: Apr. 11, 2016

(65) Prior Publication Data

US 2016/0312591 A1 Oct. 27, 2016

Related U.S. Application Data

(60) Provisional application No. 62/151,661, filed on Apr. 23, 2015.

(51) Int. Cl.
*F04B 45/027* (2006.01)
*E21B 43/12* (2006.01)
(Continued)

(52) U.S. Cl.
CPC ..... *F04B 45/027* (2013.01); *E21B 43/128* (2013.01); *F04B 17/03* (2013.01);
(Continued)

(58) Field of Classification Search
CPC ..... F04B 13/06; F04B 13/062; F04B 13/08; F04B 13/086; F04B 13/10; F04B 17/03;
(Continued)

(56) References Cited

U.S. PATENT DOCUMENTS 2,682,229 A * 6/1954 Luenberger ..... F04D 13/10 277/337
3,254,837 A * 6/1966 Falconer ..... F15B 5/003 235/200 R
4,436,488 A * 3/1984 Witten ..... F04B 47/06 310/87

(Continued)

FOREIGN PATENT DOCUMENTS

CA 2508267 A1 4/2009
JP 2008-57294 A 3/2008

OTHER PUBLICATIONS

U.S. Appl. No. 14/543,179—filed Nov. 17, 2014—Inventors: David Tanner and Ryan Semple—entitled; "Metal Bellows with Guide Rings".

*Primary Examiner* — Kenneth J Hansen
*Assistant Examiner* — Chirag Jariwala
(74) *Attorney, Agent, or Firm* — James E. Bradley; Bracewell LLP

(57) ABSTRACT

A well pump assembly includes a pump and a motor that contains a dielectric motor lubricant and a pressure equalizer containing a bellows. The bellows has an interior in fluid communication with the motor lubricant and an exterior immersed in well fluid. The bellows is axially extendable and contractible in response to a pressure differential between the well fluid and the motor lubricant. A tube has a lower end secured to a tube port in the pressure equalizer housing and an upper end secured to a lower end of the bellows. The tube has a center line that makes at least one curved flexible bend between the tube upper end and the tube lower end to enable the tube to flex as the bellows extends and contracts.

17 Claims, 2 Drawing Sheets

(51) Int. Cl.

| | |
|---|---|
| ***F04B 17/03*** | (2006.01) |
| ***F04B 23/02*** | (2006.01) |
| ***F04D 13/06*** | (2006.01) |
| ***F04D 13/10*** | (2006.01) |

(52) U.S. Cl.
CPC ..... *F04B 23/021* (2013.01); *F04D 13/062* (2013.01); *F04D 13/10* (2013.01)

(58) Field of Classification Search
CPC ..... F04B 19/22; F04B 23/02; F04B 23/021; F04B 45/02; F04B 45/024; F04B 45/027; F04B 47/06; E21B 43/128; E21B 43/14
USPC ..... 417/414
See application file for complete search history.

(56) References Cited

U.S. PATENT DOCUMENTS

| | | | | |
|---|---|---|---|---|
| 4,576,231 | A | 3/1986 | Dowling | |
| 4,683,070 | A | 7/1987 | Munsell | |
| 4,863,070 | A | 9/1989 | Andris | |
| 4,886,428 | A | 12/1989 | Olofsson | |
| 4,950,394 | A | 8/1990 | Bernhardt | |
| 6,224,343 | B1 | 5/2001 | Newcomer | |
| 6,851,935 | B2 | 2/2005 | Merrill | |
| 7,520,735 | B2 | 4/2009 | Merrill | |
| 7,576,231 | B2 | 8/2009 | Tsudera | |
| 8,651,837 | B2 | 2/2014 | Tetzlaff | |
| 2015/0330400 | A1 | 11/2015 | Tanner | |
| 2015/0337843 | A1 | 11/2015 | Tanner | |
| 2016/0017701 | A1 | 1/2016 | Tanner | |
| 2017/0306733 | A1* | 10/2017 | Reeves | E21B 43/128 |

* cited by examiner

FLEXIBLE HOSE FOR BELLOWS PRESSURE EQUALIZER OF ELECTRICAL SUBMERSIBLE WELL PUMP

FIELD OF THE DISCLOSURE

This disclosure relates in general to hydrocarbon well submersible pumps and in particular to a pressure equalizer for the motor that has a metal bellows and a flexible hose in fluid communication with the metal bellows.

BACKGROUND

Electrical submersible pumps (ESP) are commonly used to pump well fluid from oil producing wells. A typical ESP has an electrical motor that drives a pump. The motor is filled with dielectric motor lubricant for lubricating motor bearings. A pressure equalizer or compensator couples to the motor for reducing a pressure differential between well fluid on the exterior of the motor and the motor lubricant. The pressure equalizer may be on the upper end or the lower end of the motor.

One type of pressure compensator has a metal bellows with a side wall having corrugations. Normally, an interior of the bellows contains motor lubricant that is in communication with motor lubricant in the motor. A well fluid port in the housing containing the bellows admits well fluid to the exterior of the bellows. The bellows extends and contracts in response to differences between the well fluid pressure and the motor lubricant pressure.

One bellows arrangement comprises a larger diameter or outer bellows joined with a smaller diameter or inner bellows. The outer bellows connects to a port at one end of the housing, and the inner bellows joins a port at the other end. The interiors of the inner and outer bellows are in fluid communication with each other. The inner bellows allows the length of the outer bellows to extend and contract. The inner and outer bellows arrangement works well but the combined arrangement is more costly than a single bellows.

SUMMARY

A well pump assembly, comprises a pump and a motor operatively coupled to the pump for driving the pump. The motor contains a dielectric motor lubricant. A pressure equalizer housing couples to the motor, the pressure equalizer housing having a bulkhead. A well fluid port admits well fluid into the housing. A bellows mounted in the housing has an interior and an exterior. The bellows axially extends and contracts to reduce a pressure differential between the motor lubricant and the well fluid surrounding the motor. The bellows has a bellows end that moves toward the bulkhead while moving from a contracted to an extended position. The housing also has a tube port. A tube connects to the tube port and to the bellows end. The tube is in fluid communication with the interior of the bellows. The tube has a centerline that makes at least one turn relative to the axis to enable the tube to flex as the bellows moves between the contracted and extended positions.

The tube has a cylindrical side wall extending from the bellows end to the tube port that is free of corrugations. The centerline may have a pair of the turns, defining a gooseneck configuration for the tube. Alternately, the tube centerline may have a plurality of helical turns. The helical turns may be around the axis. A volume of the tube regains constant while undergoing flexing as the bellows moves between the contracted and extended positions.

The tube port is located in the bulkhead in the embodiments shown. In one embodiment, the assembly has a sensor cavity with a sensor in the cavity for measuring a parameter of the motor lubricant. The tube port communicates motor lubricant in the tube with, the sensor cavity.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
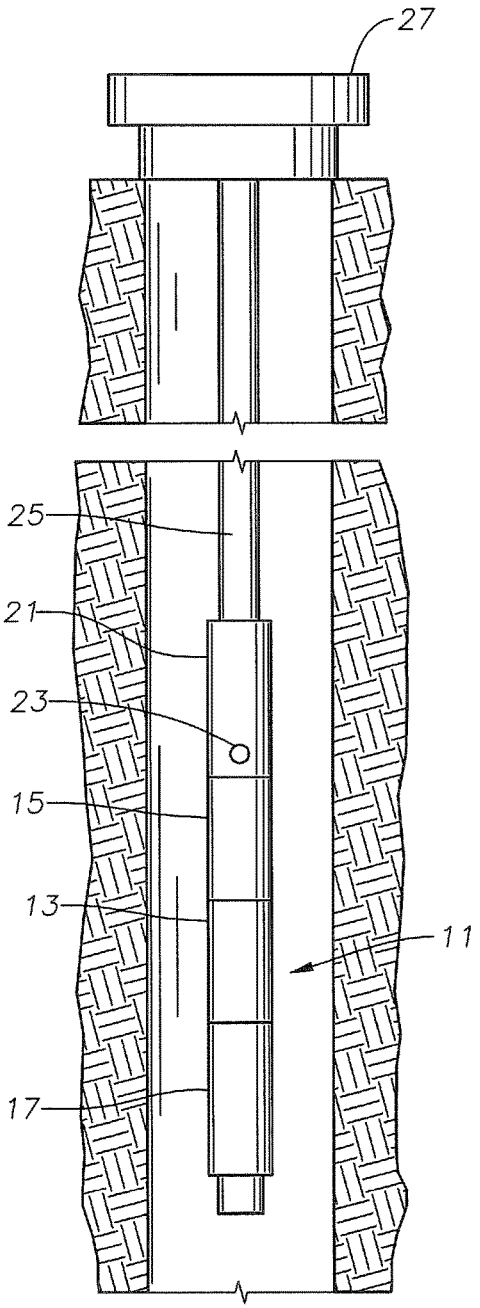
FIG. 1 is a schematic side view of a pump assembly in accordance with this disclosure.

Referring to FIG. 1, an electrical submersible pump (ESP) 11 typically includes an electrical motor 13. Motor 13 is normally a three-phase AC motor and may be connected in tandem to other motors. A shaft seal or thrust bearing unit 15 is illustrated at an upper end of motor 13. The terms "upper" and "lower" are used only for convenience and not in a limiting manner because ESP 11 may be operated in horizontal portions of wells. A pressure equalizer 17 is shown connected to a lower end of motor 13. Pressure equalizer 17 has features to reduce a pressure differential between a dielectric motor lubricant in motor 13 and the exterior well fluid hydrostatic pressure.

a pump 21 connects to the upper end of shaft seal 15 in this example. Pump 21 could be a centrifugal pump with a large number of stages, each stage having an impeller and a diffuser. Alternately, pump 21 could be another type, such as a progressing cavity pump. Pump 21 has an intake 23 for admitting well fluid. A gas separator (not shown) could be connected to the lower end of pump 21; if so, intake 23 would be in the gas separator. A string of production tubing 25 secures to the upper end of pump 21 and supports ESP 11 in a well. Production tubing string 25 may be sections of tubing with threaded ends secured together, or it could be continuous coiled tubing. A wellhead assembly 27 at the upper end of the well supports production tubing string 25 and controls the few of well fluid.

Figure 2:
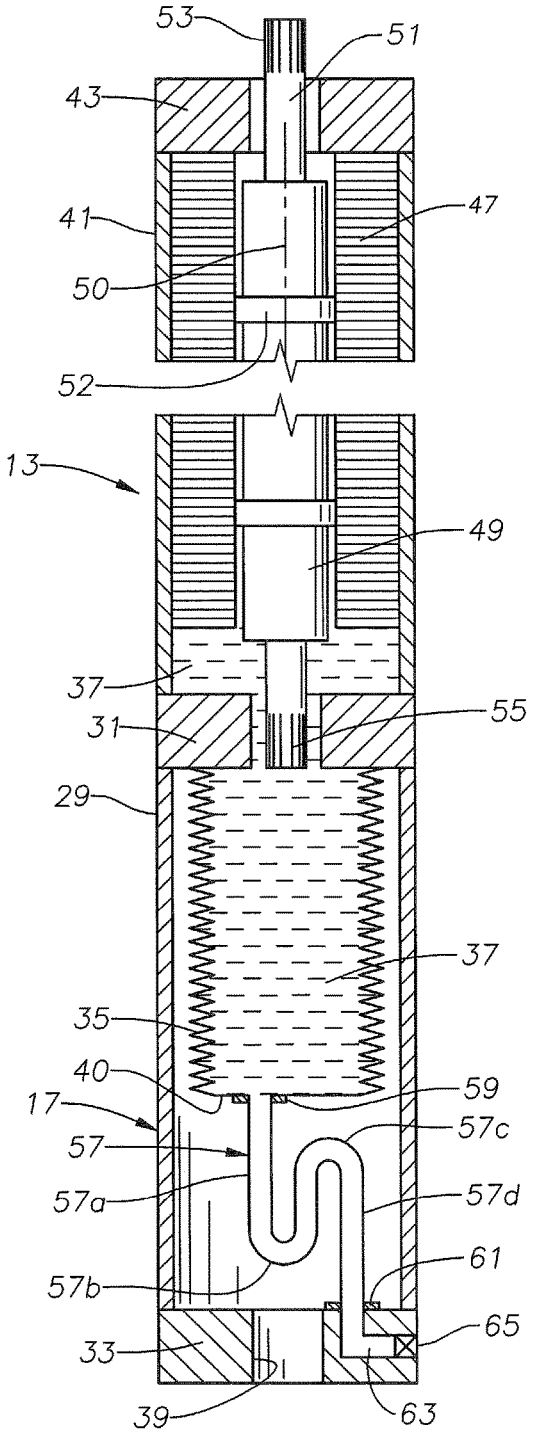
FIG. 2 is a schematic enlarged sectional view of the motor of FIG. 1 and a first embodiment of a pressure equalizer of the pump assembly of FIG. 1.

Referring to the schematic representation of FIG. 2, pressure equalizer 17 has a tubular housing 29. An upper adapter 31, which may be considered to be part of housing 29, secures to the upper end of housing 29, such as by threads, defining an upper end of housing 29. Housing 29 has a lower end or bulkhead 33 which may be at the lower end of ESP 11, or lower end 33 may be an adapter or connector to connect to another component of ESP 11. Upper adapter 31 and lower end 33 could be parts of bolted connections or connections employing a rotatable threaded collar.

A flexible, pressure compensating element, such as a bellows 35, mounts within housing 29 to the lower side of upper adapter 31 in this example. Bellows 35 is formed of a metal and has a corrugated side wall. In this embodiment, the interior of bellows 35 is filled with motor lubricant 37 employed for lubricating the rotating components of motor 13. The exterior of bellows 35 may be immersed in well fluid that flows in from a port 39 in housing 29. Alternately, bellows 35 may be immersed in an intermediate or secondary liquid that is separated from well fluid by an additional flexible element (not shown). Also, bellows 35 could be alternately arranged with well fluid in its interior and motor lubricant on its exterior.

When ESP 11 (FIG. 1) is installed in a well, in the embodiment shown, the hydrostatic pressure of well fluid on the exterior of ESP 11 is communicated to the interior of housing 29 in the chamber surrounding bellows 35. The interior of bellows 35 is sealed from the liquid in housing 29 surrounding bellows 35. As bellows 35 moves from a contracted position toward an extended position to equalize a pressure differential, a closed lower end 40 of bellows 35 moves toward housing lower end 33.

Motor 13 has a tubular housing 41 with an upper connector or adapter 43 at the upper end that secures to pump 21 (FIG. 1). Upper adapter 31 of pressure equalizer 17 secures to the lower end of motor 13, such as by bolting or a threaded rotatable collar. A stator 47 extends most of the length of motor housing 41. Stator 47 comprises thin metal discs or laminations with windings extending through slots in the laminations. A rotor 49 mounts within a central bore of stator 47. Rotor 49 is also made up of laminations and has copper rods extending longitudinally through holes in fee laminations. Rotor 49 mounts to a drive shaft 51, which is located on an axis 50 of motor housing 41. Rotor 49 is made up in rotor sections separated by radial bearings 52. Shaft 51 has an upper splined end 53 and a lower end 55. Upper splined end 53 is within upper adapter 43 and lower end 55 terminates at the lower end of motor 13.

A flexible hose or tube 57 extends between lower end 40 of bellows 35 and the upper side of housing lower end 33. Tube 57 is not a bellows, however it may have a variety of shapes and is designed to flex as bellows 35 moves between contracted and extended positions. Tube 57 has a cylindrical side wall, and preferably the side wall of tube 57 from bellows lower end 40 to housing lower end 33 is free of corrugations. Tube 57 may be formed of braided metal, corrugated metal, flexible pipe and the like. The metal may be an anti-corrosive material such as stainless steel, Inconel or Monel.

In the embodiment of FIG. 2, tube 57 is in the configuration of a gooseneck. Tube 57 has a center line that makes at least one curve or bend to enable tube 57 to flex as bellows 35 moves between contracted and extended positions. In FIG. 2, tube 57 has a straight upper end portion 57*a* that extends downward from bellows 35. A upward curved bend 57*b* joins a lower end of upper end portion 57 and curves upward. A downward curved bend 57c joins an upper end of upward bend 57*b* and curves downward to a junction with a straight lower end portion 57*d* that joins housing lower end 33. Upper end portion 57*a* and lower end portion 57*b* are parallel with each other and offset from axis 50. The center line has one turn or bend at upward curved bend 57*b* and another at curved bend 57*c* . Preferably all of the portions 57*a*,57*b*,57*c* and 57*d* are flexible.

Figure 3:
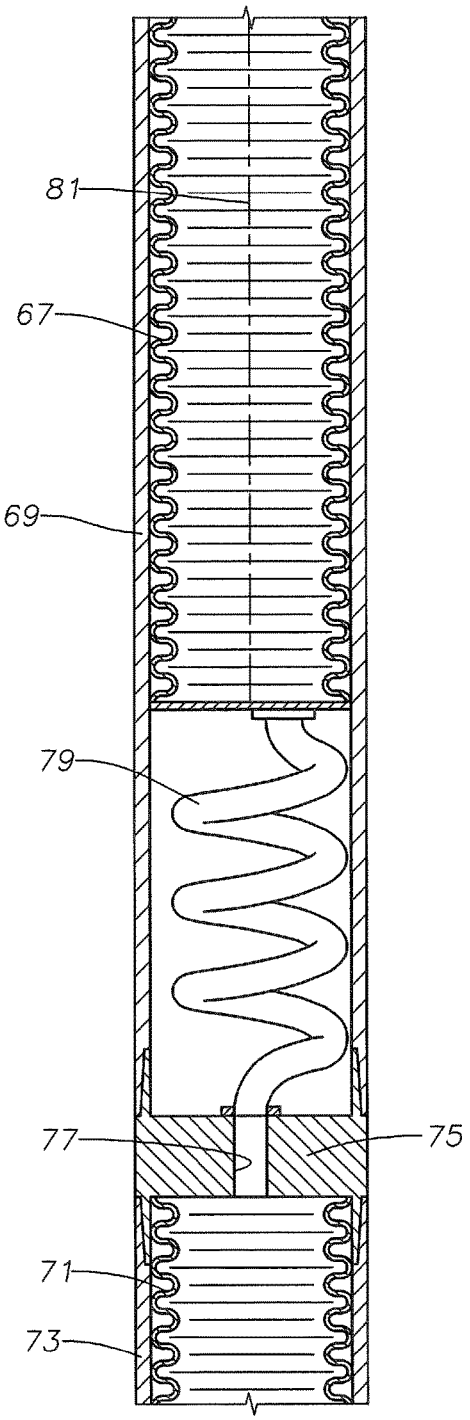
FIG. 3 is a schematic sectional view of a second embodiment of a pressure equator.
Figure 4:
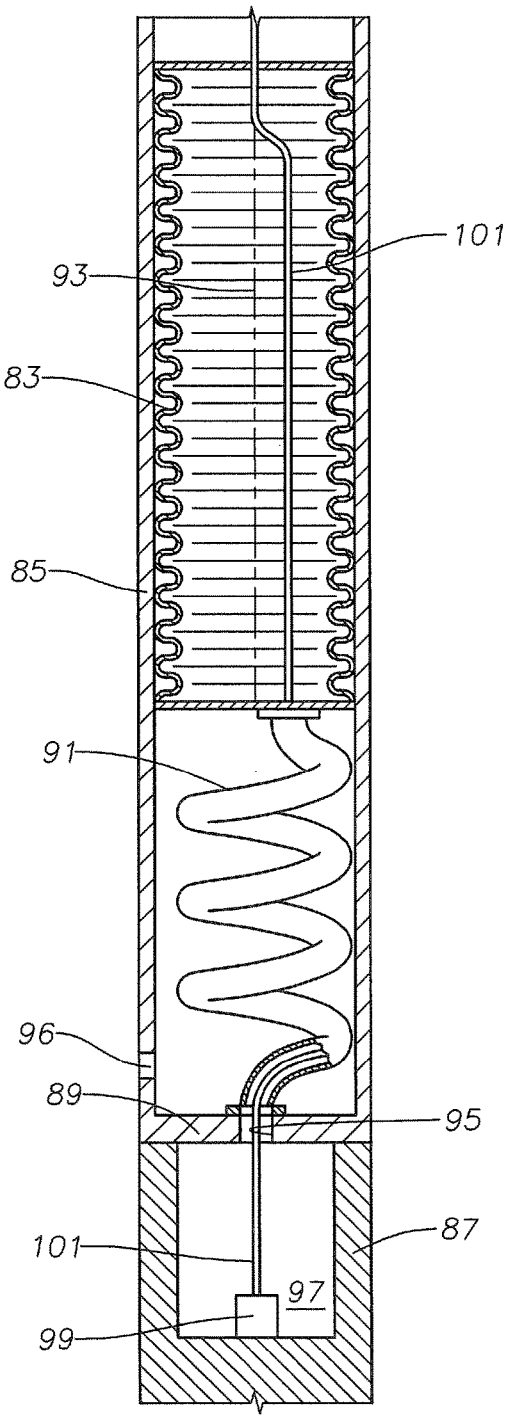
FIG. 4 is a schematic sectional view of a third embodiment of a pressure equalizer.

An upper fitting 59 sealingly joins tube 57 to lower end 40 of bellows 35, which is closed except for the port created by upper fitting 59. A lower fitting 61 sealingly joins the lower end of tube 57 to a tube port 63 located in housing bulkhead or lower end 33. Upper and lower fittings 59, 61 may be a variety of types, including threaded fittings and brazed or welded joints. In FIG. 2, upper fitting 59 is offset to one side of axis 50 and lower fitting 61 is offset to the opposite side of axis 50. Upper and lower fittings 59,61 communicate motor lubricant 37 from bellows 35 through tube 57 to port 63. Port 63 may lead through housing lower end 33 to other components, as shown in FIGS. 3 and 4. Alternately, port 63 may lead to the exterior of housing lower end 33, as shown in FIG. 2, and contain a removable plug 65. In that instance, port 63 is employed for filling bellows 35 with motor lubricant 37 before deploying ESP 11. The filling method may include drawing a vacuum on bellows 35 through port 63.

Tube 57 may have a constant outer diameter and inner diameter throughout its length from upper fitting to lower fitting 61. The outer diameter is much smaller than the outer diameter of bellows 35, which may range about 3.3 to 7.75 inch, for example. In one embodiment, the outer diameter of tube 57 may be about 0.5 inch and the inner diameter 0.25 inch. The inner and outer diameters of tube 57 preferably do not change while bellows 35 moves between contracted and extended positions. Also, tube 57 retains a constant volume as it flexes while bellows 35 extends and contracts.

As bellows 35 extends, lower end 40 of bellows 35 approaches housing lower end 33, causing the axial distance between tube upper fitting 59 and tube lower fitting 61 to decrease. Optionally, a stop (not shown) may be located in housing above lower end 33 and below bellows 35 to limit the extension of bellows 35. As bellows 35 contracts, the axial distance from tube lower fitting 61 to tube upper lining 59 increases. At the maximum contracted position of bellows 35, upper and lower bends 57*a*, 57*c* may straighten substantially. The distance that bellows 35 moves item its extended to its contracted position may be about half the axial length of bellows 35 measured while in its extended position.

Referring to FIG. 3. In this embodiment, an upper bellows 67 is located in an upper housing section 69. A lower bellows 71 is located in a lower housing section 73, which is secured to the upper housing section 69 by threaded connector or guide 75. Connector 75 alternately could be part of a bolted or threaded sleeve connection between tandem pressure equalizers. In this example, connector 75 separates an upper chamber in upper housing section 69 from a lower chamber in lower housing section 73. Communication port 77 extends through connector 75 to communicate motor lubricant in the interior of the upper bellows 67 with the interior of lower bellows 71. A port (not shown) will admit well fluid to the interior of upper housing section 69 surrounding upper bellows 67.

A flexible tube 79 has an upper end that sealingly joins the lower end of upper bellows 67. A lower end of flexible tube 79 sealingly joins communication port 77. In this embodiment, tube 79 has a plurality of curved, flexible bends, defining a spiral or helical configuration, with multiple turns or beads extending: around axis 81. Alternately, tube 79 could have the same gooseneck configuration as tube 5 of FIG. 2. Tube 79 communicates motor lubricant from upper bellows 67 to lower bellows 71 and flexes while upper bellows 67 moves between a contracted and an extended position. Tube 79 also has a volume that remains constant while it flexes. Other than the spiral configuration, tube 79 may be constructed the same as tube 57.

Referring to FIG. 4, a bellows 83 is located with a housing 85 that connects to a lower end of motor 13 (FIG. 1). In this embodiment, a sensor unit 87 secures to the bulkhead or lower end 89 of housing 85. Alternatively, a similar sensor unit could attach to housing lower end 33 in the FIG. 2 embodiment or the lower end of lower housing section 73 in the FIG. 3 embodiment. Housing lower end 89 could be part of a bolted connection or a connection with a threaded rotatable collar.

A flexible tube 91 extends from the lower end of the bellows 83 to housing lower end 89. In this example, tube 91 is formed in the shape of a helix, as in FIG. 3. Tube 91 has multiple turns or bends extending around an axis 93 in this embodiment, but it could have a gooseneck housing lower end 89. A well fluid entry port 96 is schematically illustrated for admitting well fluid into the interior of housing 85 to immerse tube 91 and bellows 83.

Port 95 leads to a cavity 97 in sensor unit 87. At least one sensor 99 is mounted in cavity 97 for immersion in motor lubricant passing from bellows 83 through tube 91 and port 95. Sensor 99 measures parameters of the motor lubricant, such as pressure and temperature.

A sensor signal line 101, such as an electrical wire, extends from sensors 99 through port 95 and tube 91. Sensor line 101 extends from tube 91 through bellows 13 to motor 13 (FIG. 1) for sending power to sensors 99 and conveying signals fern sensors 99 proportional to parameters sensed. Sensor line 101 may join wiring in motor 13 for transmission of signals up a motor power cable (not shown). Alternately, sensor line 101 may extend as a separate line within the bundle of the motor power cable. Rather than extend through flexible tube 91, sensor line 101 could be located within housing 85 on the exterior of tube 91 and bellows 83.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. For example, the bellows and flexible tubes shown could be inverted from the arrangements shown, with the flexible tube extending torn an upper end of the bellows to the upper end of the housing.

The invention claimed is:

1. A well pump assembly, comprising:

a pump;

a motor operatively coupled to a lower end of the pump for driving the pump, the motor containing a dielectric motor lubricant;

a pressure equalizer housing having a longitudinal axis, the pressure equalizer housing having an upper end coupled to a lower end of the motor and a lower end;

a well fluid port that admits well fluid into the pressure equalizer housing;

a bellows having a bellows upper end fixed to the pressure equalizer housing upper end with an interior of the bellows in fluid communication with the motor lubricant and an exterior adapted to be immersed in well fluid in the pressure equalizer housing, the bellows having a bellows lower end spaced above the pressure equalizer housing lower end, the bellows being axially extendable and contractible in response to a pressure differential between the well fluid in the pressure equalizer housing and the motor lubricant;

a tube port in the lower end of the pressure equalizer housing;

a tube in the pressure equalizer housing that extends between the bellows lower end and the lower end of the pressure equalizer housing, the tube having a tube lower end secured to the tube port and a tube upper end secured to the bellows lower end for movement therewith, the tube having an interior in fluid communication with the motor lubricant in the bellows, the tube having an exterior adapted to be immersed in well fluid in the pressure equalizer housing; and the tube having a center line that makes at least one curved flexible bend between the tube upper end and the tube lower end to enable the tube to flex as the bellows extends and contracts.

2. The assembly according to claim 1, wherein the tube has a cylindrical side wall extending from the bellows end to the tube port that is free of corrugations.

3. The assembly according to claim 1, wherein the at least one curved flexible bend comprises a pair of the curved flexible bends, defining a gooseneck configuration for the tube.

4. The assembly according to claim 1, wherein the at least one curved flexible bend comprises a plurality of helical turns.

5. The assembly according to claim 1, wherein the at least one curved flexible bend comprises a plurality of helical turns around the axis.

6. The assembly according to claim 1, wherein a volume of the tube remains constant while undergoing flexing as the bellows moves between contracted and extended positions.

7. The assembly according to claim 1, wherein the tube comprises:

an upper straight portion and a lower straight portion, the straight portions extending axially and being radially offset from each other relative to the axis; and the at least one curved flexible bend is located at a junction between the upper straight portion and the lower straight portion.

8. The assembly according to claim 1, wherein:

the tube port comprises a fill port for introducing motor lubricant into the bellows prior to installation in a well; and a removable plug is secured in the tube port.

9. The assembly according to claim 1, further comprising:

a sensor unit mounted to the pressure equalizer housing lower end and having a sensor cavity;

a sensor in the sensor cavity for measuring a parameter of the motor lubricant; and wherein the tube port communicates motor lubricant from the bellows to the sensor cavity via the tube.

10. The assembly according to claim 9, further comprising a sensor signal line extending from the sensor through the tube port, the tube, the bellows and into the motor.

11. A well pump assembly comprising:

a pump;

a motor operatively coupled to a lower end of the pump for driving the pump, the motor containing a dielectric motor lubricant;

a pressure equalizer housing having a longitudinal axis, the pressure equalizer housing having an upper end coupled to a lower end of the motor and a lower end;

a well fluid port that admits well fluid into the pressure equalizer housing;

a bellows having a bellows upper end fixed to the pressure equalizer housing upper end with an interior of the bellows in fluid communication with the motor lubricant and an exterior adapted to be immersed in well fluid in the pressure equalizer, the bellows having a bellows lower end spaced above the pressure equalizer housing lower end, the bellows being axially extendable and contractible in response to a pressure differential between the well fluid in the pressure equalizer housing and the motor lubricant;

a tube port in the lower end of the pressure equalizer housing;

a tube having a tube lower end secured to the tube port and a tube upper end secured to the bellows lower end, the tube having an interior in fluid communication with the motor lubricant in the bellows;

the tube having a center line that makes at least one curved flexible bend between the tube upper end and the tube lower end to enable the tube to flex as the bellows extends and contracts;

a lower bellows housing connected to the pressure equalizer housing lower end;

a lower bellows located in the lower bellows housing; and wherein the tube port is in fluid communication with an interior of the lower bellows.

12. The assembly according to claim 11, wherein the at least one curved flexible bend comprises a plurality of curved flexible bends, defining a spiral configuration extending in a helix around the axis.

13. A well pump assembly, comprising:

a pump;

a motor operatively coupled to the pump for driving the pump, the motor containing a dielectric motor lubricant;

a pressure equalizer housing having a longitudinal axis and coupled to the motor, the pressure equalizer housing having a bulkhead;

a well fluid port that admits well fluid into the pressure equalizer housing;

a bellows having an open end fixed in the pressure equalizer housing with an interior of the bellows in fluid communication with the motor lubricant and an exterior adapted to be immersed in well fluid in the pressure equalizer housing, the bellows having a closed end that moves toward and away from the bulkhead as the bellows extends and contracts in response to a pressure differential between the well fluid in the pressure equalizer housing and the motor lubricant;

a tube port in the bulkhead;

a tube in the pressure equalizer housing, the tube having one end connected to the bellows closed end for movement therewith and another end connected to the tube port the tube having a tube interior in fluid communication with the motor lubricant in the bellows and the tube having an exterior adapted to be immersed in the well fluid in the pressure equalizer housing;

the tube being smaller in outer diameter than an outer diameter of the bellows closed end;

the tube having at least one flexible curved section that enables the tube to move from a tube extended position while the bellows is in a bellows contracted position to a tube contracted position while the bellows is in a bellows extended position; and wherein a volume of the tube interior remains constant between the tube extended position and the tube contracted position.

14. The assembly according to claim 13, wherein the at least one flexible curved section comprises a plurality of curved flexible bends, defining a spiral portion extending in a helix around the axis.

15. The assembly according to claim 13, wherein the tube has a cylindrical side wall extending from the bellows closed end to the tube port that is free of corrugations.

16. The assembly according to claim 13, further comprising:

a sensor unit mounted to the bulkhead and having a sensor cavity;

a sensor in the sensor cavity for measuring a parameter of the motor lubricant; and wherein the tube port communicates motor lubricant from the bellows to the sensor cavity via the tube.

17. The assembly according to claim 13, wherein the tube comprises:

an upper straight portion and a lower straight portion, the straight portions extending axially and being radially offset from each other relative to the axis; and the at least one flexible curved section is located at a junction between the upper straight portion and the lower straight portion.

* * * * *